US008720681B1

(12) United States Patent
Hancock et al.

(10) Patent No.: US 8,720,681 B1
(45) Date of Patent: May 13, 2014

(54) QUIET OPENING AND CLOSING BINOCULAR POUCH

(71) Applicants: Jeffrey D. Hancock, Uintah, UT (US); Christopher N. Schenck, Uintah, UT (US)

(72) Inventors: Jeffrey D. Hancock, Uintah, UT (US); Christopher N. Schenck, Uintah, UT (US)

( * ) Notice: Subject to any disclaimer, the term of this patent is extended or adjusted under 35 U.S.C. 154(b) by 0 days.

(21) Appl. No.: 13/986,182

(22) Filed: Apr. 8, 2013

(51) Int. Cl.
*B65D 85/38* (2006.01)

(52) U.S. Cl.
USPC ..... 206/316.3; 206/818; 190/119; 190/126; 224/183; 224/909

(58) Field of Classification Search
USPC ..... 206/320, 316.1, 316.3, 701, 576, 472, 206/818; 190/119, 121, 122, 126; 224/183, 224/909
See application file for complete search history.

(56) References Cited

U.S. PATENT DOCUMENTS

| | | | | | |
|---|---|---|---|---|---|
| 4,940,250 | A * | 7/1990 | Corrado | 206/37.1 |
| 5,799,975 | A * | 9/1998 | Crick | 280/770 |
| 5,955,948 | A * | 9/1999 | Howell | 340/568.7 |
| 6,126,012 | A * | 10/2000 | Roegner | 206/579 |
| 7,699,083 | B1 * | 4/2010 | Kim | 150/160 |
| 8,056,713 | B2 * | 11/2011 | Evans | 206/316.3 |
| 8,132,669 | B1 * | 3/2012 | Stubel | 206/316.3 |
| 8,215,465 | B2 * | 7/2012 | Iceberg et al. | 190/125 |
| 2007/0051645 | A1 * | 3/2007 | Hassett | 206/316.2 |
| 2009/0288744 | A1 * | 11/2009 | Moshirisfahini et al. | 150/104 |
| 2009/0301911 | A1 * | 12/2009 | Rubin | 206/315.11 |

* cited by examiner

*Primary Examiner* — Jacob K Ackun

(57) ABSTRACT

A quiet opening and closing clam shell pouch with a bag and a hinge connected lid, each of the pouch and lid having a peripheral wall, a soft compressible sleeve on the peripheral wall of the bag and surrounding an open mouth of the bag and on a peripheral wall of the lid; a solid shape defining and shaping member in each soft compressible sleeve shapes and holds open the mouth of the bag and shapes the periphery of the lid so that the lid can be pivoted to close the mouth of the bag; cooperating surfaces of magnets, enrobed in a soft net mesh, are spaced around the peripheral walls and alongside each soft compressible sleeve to pull the padded sleeves together and to compress the sleeves and soft strands of the net mesh that extend across the cooperating surfaces of the magnets.

4 Claims, 5 Drawing Sheets

QUIET OPENING AND CLOSING BINOCULAR POUCH

CROSS REFERENCE TO RELATED APPLICATIONS

Figure 1:
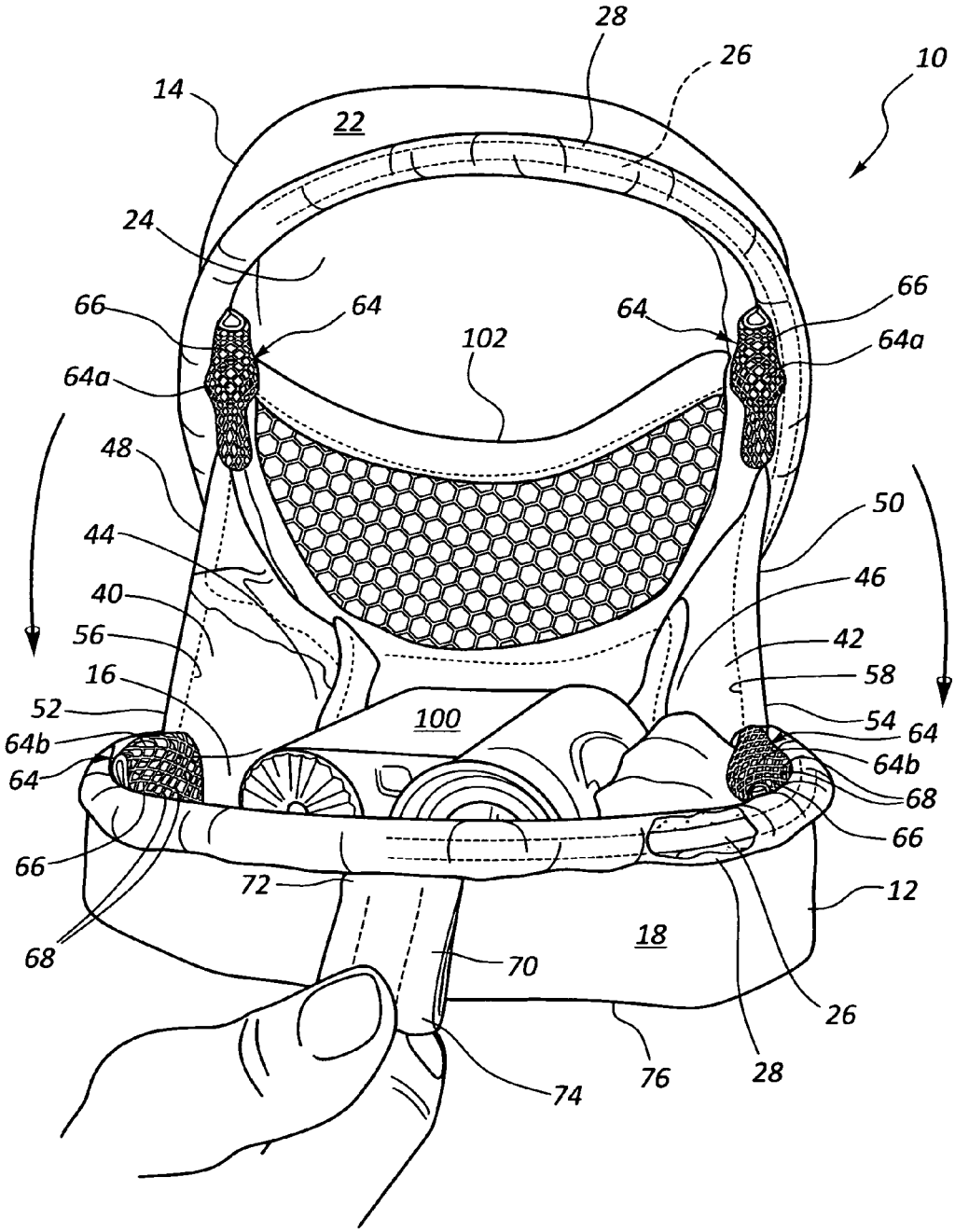

Not applicable.

STATEMENT REGARDING FEDERALLY SPONSORED RESEARCH OR DEVELOPMENT

Not Applicable.

REFERENCE TO MICROFICHE APPENDIX

Not applicable.

BACKGROUND OF THE INVENTION

1. Field of the Invention

This invention relates to pouches that can be used for carrying articles and is particularly useful when it is highly desirable to have a pouch that will open and close without creating a noise. Game hunters, for example often like to carry binoculars, range finders and other such equipment in a chest pouch or a belt pouch when stalking game, but do not want the animal being stalked to be alerted and to flee upon hearing a noise resulting from opening or closing a pouch to retrieve an article for use.

Silent opening and closing pouches, used to carry other articles, i.e., from eye glasses and combs, to lipstick and other make-up items, allow a user to have items in a pouch, and available, in situations where even a small noise can be distracting. For example, a small noise can be distracting to others in church, at a concert, in a movie theater, or in a wide variety of meetings and other gatherings.

While some other easily opened and closed pouches have similarities to the present invention, such other pouches do not open and close silently and/or are generally more costly to produce and/or they do not have a magnetic closure means with the holding power of the closure means of the present invention.

2. Prior Art

Pouches with a pivotally mounted lid portion that will close over an open mouth of a bag portion to secure an article or a number of articles in the pouch are well known. Pouches that use magnetic force to hold the pivoted lid portion in position closing the mouth of the bag portion are also known. These known pouches generally have seams sewn into matching peripheral edges of the lid and bag mouths and a pair of strong, flexible magnets that are respectively inserted into the mating seams so that they have opposing polarities and will forcefully attract one another, even through the rolled fabric bead covers of the inserted magnets. Since the magnets are covered when they come together there is little, if any, sound created when the beads of the lid and mouth of the bag portion come together.

SUMMARY OF THE INVENTION

Objects of the Invention

It is a principal objects of the present invention to provide a pouch for binoculars and the like that is readily carried on either a waist belt or a chest harness of a user.

Anther object is to provide a pouch for binoculars that has a bag with a wide mouth and a clam-shell type lid that will silently close the wide mouth, using magnetic attraction as a closing force.

Yet another object is to provide a pouch for binoculars that, when connected to either a belt or a chest strap of a user, will have a wide mouth of the pouch opening away from the user and a lid that is hinge connected to a bottom of the wide mouth of the pouch pivotable between an upright position closing the wide mouth of the pouch and an open position extending substantially horizontal from the body of the user to display and make available to a user, binoculars, or other objects carried in the closed pouch.

Still another object of the invention is to provide a pouch for binoculars utilizing low-cost, small, spaced apart, co-operating, opposed magnets enrobed in close fitting nets made from interconnected soft strings. The co-operating surfaces of enrobed magnets spaced around the rim of the open mouth of the pouch and enrobed aligned magnets spaced around a flange of the lid insure adequate holding power of the magnets, while allowing the lid to be pulled onto and to silently close the bag by magnetic attraction at the mouth of the bag.

Features of the Invention

Principal features of the invention include a pouch having a wide mouth bag and a lid that is hinge connected such that the lid will close the wide mouth bag.

Other features of the invention include a plurality of magnets, each magnet having spaced faces of opposite polarities. A mesh holder for each magnet is made of a durable, soft small diameter material, such as thread or string. Each mesh holder enrobes a magnet, with the magnet placed in the holder through an opening into the holder, which is subsequently closed. The holders and magnets therein are spaced around and sewn to fabric inner faces of the wide mouth of the bag and a flange projecting from an outer periphery of the lid. Holders with magnets therein are positioned such that the magnets spaced around the open mouth of the pouch and having a magnetic surface of one polarity facing outwardly of the mouth of the pouch will each have a corresponding holder with magnet of opposite polarity therein spaced around the flange of the lid that will cooperate with the magnets on the mouth of the pouch.

Additional objects and features of the invention will become apparent t from the following detailed description, drawings and claims to those skilled in the art to which the invention pertains.

DETAILED DESCRIPTION OF THE DRAWINGS

Listing of Reference Numbers and Components which they Identify

| NUMBER | COMPONENT |
|---|---|
| 10 | pouch. |
| 12 | bag. |
| 14 | lid. |
| 16 | padded central section of bag 12. |
| 18 | peripheral wall of bag 12. |
| 22 | peripheral wall of lid 14. |
| 24 | padded central section of lid 14. |
| 26 | rigid metal rods in sleeves 28. |

-continued

| NUMBER | COMPONENT |
|---|---|
| 28 | padded fabric sleeves 28. |
| 30 | fabric hinge strip. |
| 32 | end of hinge strip 30 |
| 34 | other end of hinge strip 30. |
| 36 | side edge of hinge strip 30 |
| 38 | side edge of hinge strip 30. |
| 40 | triangular fabric pieces connected to bag 12. |
| 42 | triangular fabric pieces connected to lid 14. |
| 44 | apex of triangular fabric piece 40. |
| 46 | apex of triangular fabric piece 42. |
| 48 | edge of fabric piece 40. |
| 50 | edge of fabric piece 42. |
| 52 | edge of fabric piece 40. |
| 54 | edge of fabric piece 42. |
| 56 | seam on triangular fabric piece 40. |
| 58 | seam on triangular fabric piece 42. |
| 60 | base edge of triangular fabric piece. 40. |
| 62 | base edge of triangular fabric piece. |
| 64 | small magnets enrobed in mesh net 66. |
| 64a | cooperating surfaces of magnets on peripheral wall 18. |
| 64b | cooperating surfaces of magnets on peripheral wall 22. |
| 66 | mesh nets. |
| 68 | strands of the mesh nets. |
| 70 | strap on back of bag 12. |
| 72 | one end of strap 70. |
| 74 | the opposite end of strap 70. |
| 76 | back of bag 12. |
| 78 | reinforcement holder. |
| 80 | cut away top notch of the reinforcement holder. |
| 82 | cut away bottom notch. |
| 84 | cut away side notch. |
| 86 | cut away side notch. |
| 88 | central opening through the reinforcement holder. |
| 90 | corner of reinforcement holder 78. |
| 92 | corner. |
| 94 | corner. |
| 96 | corner. |
| 98 | pull tab on lid 14. |
| 100 | binoculars. |
| 102 | mesh pockets. |

Figure 2:
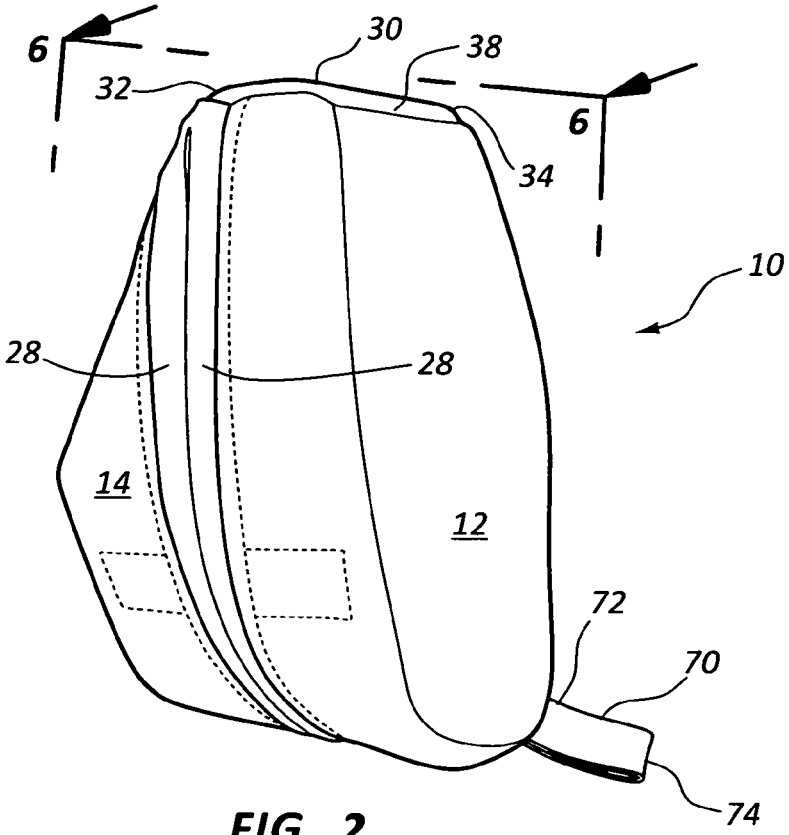
Figure 3:
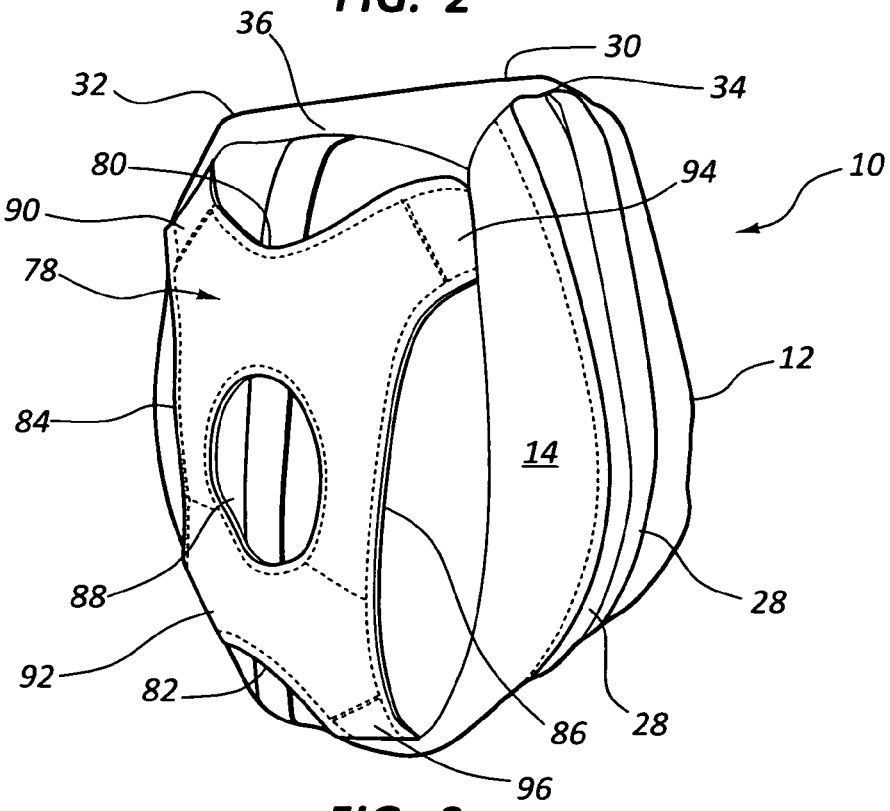
Figure 4:
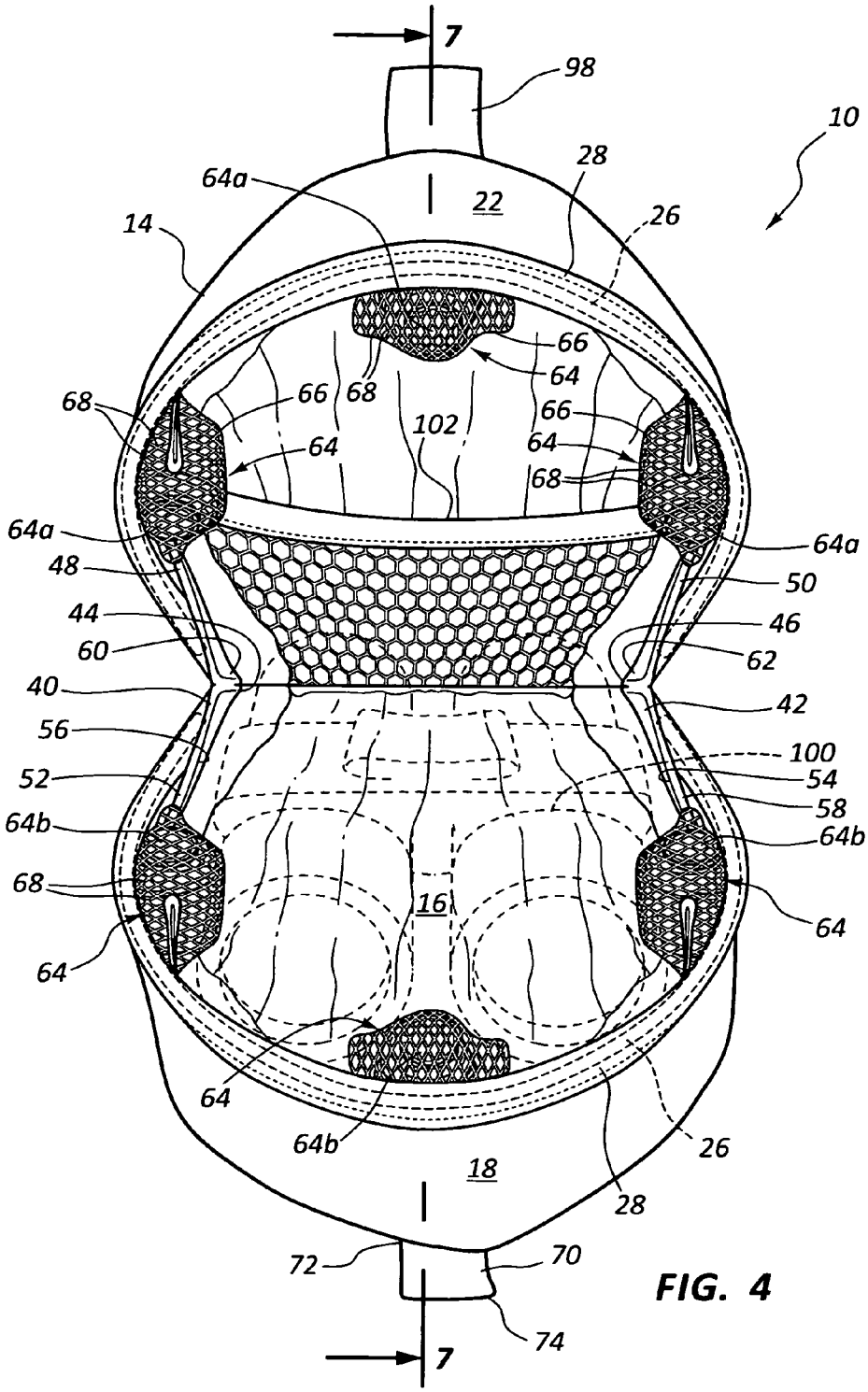
Figure 5:
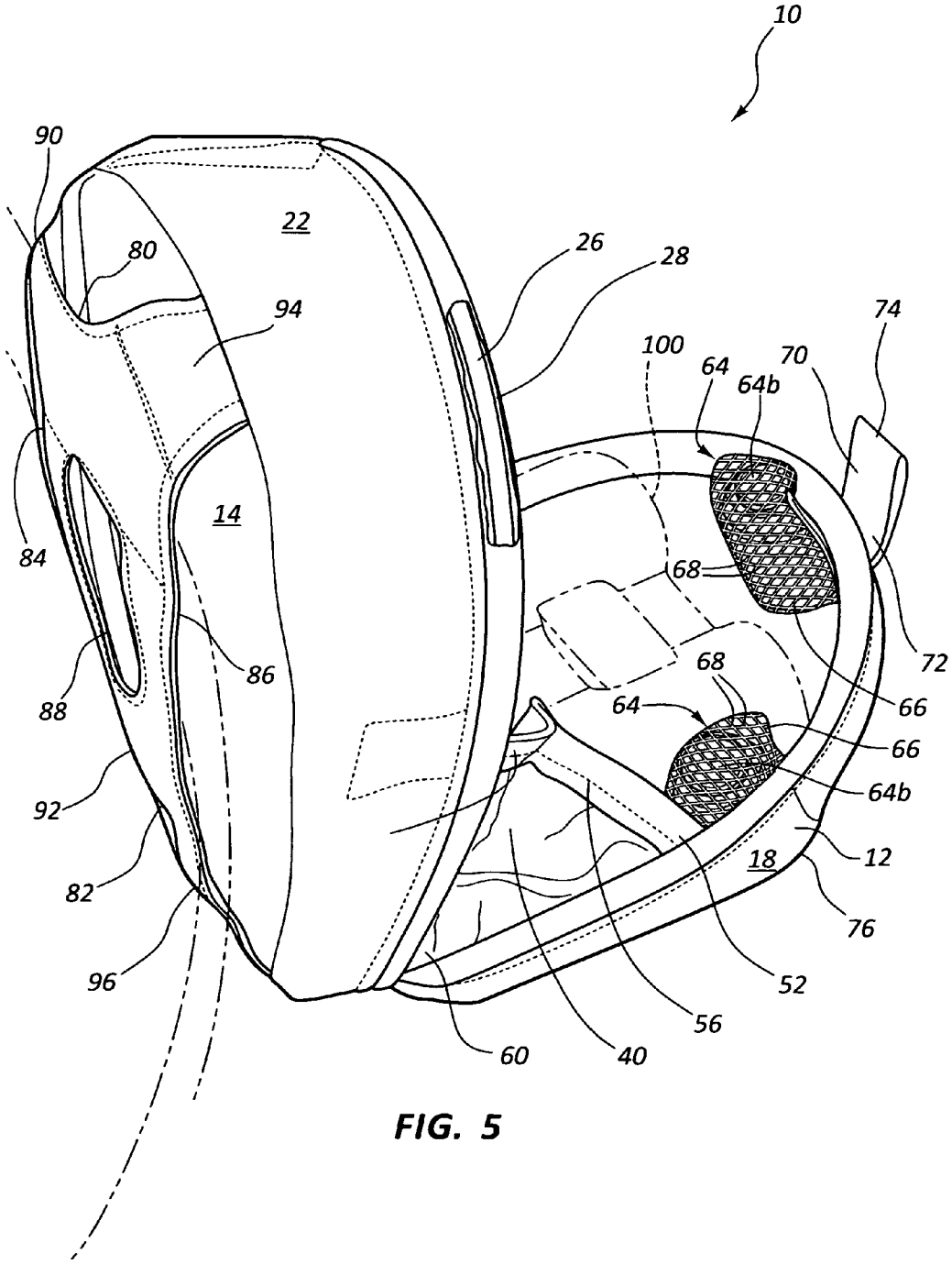
Figure 6:
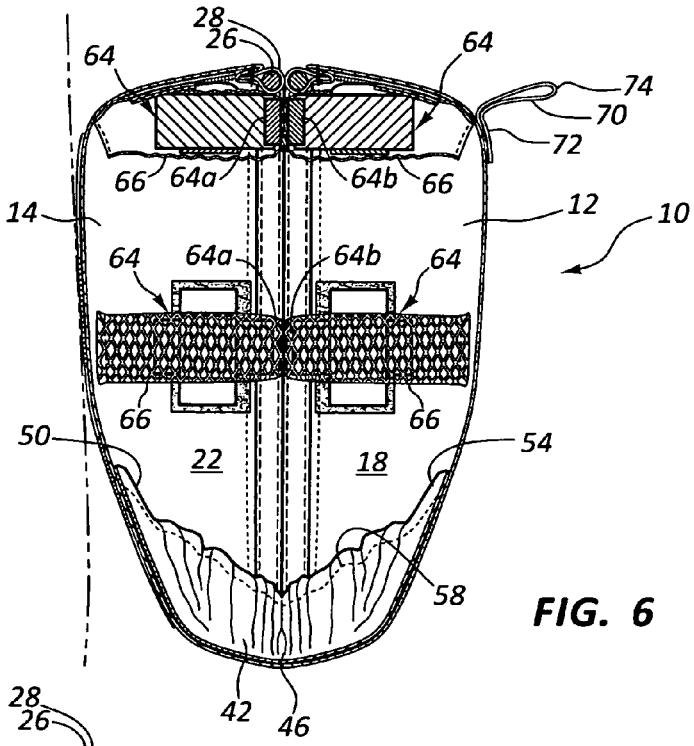
Figure 7:
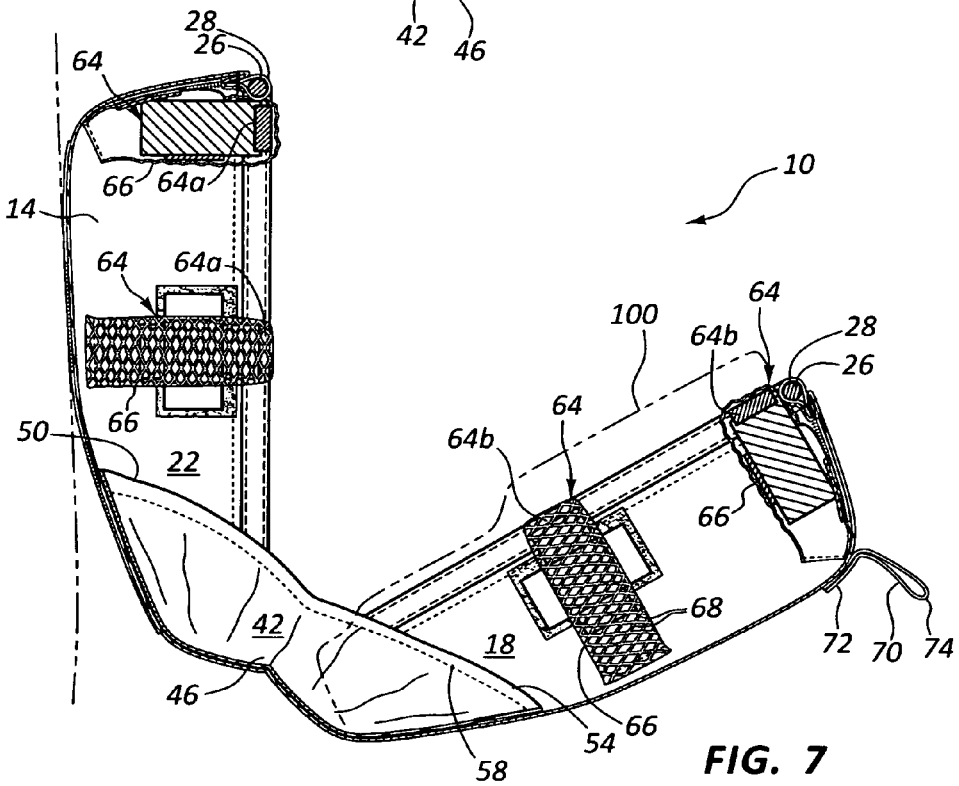

In the Drawings;

FIG. 1 is a perspective view of the pouch of the invention, taken from a front corner of the pouch, with the lid in open position and with binoculars displayed in and available for removal from the open lid;

FIG. 2, a perspective view of the closed pouch, taken from the front and one side of the pouch;

FIG. 3, a perspective view of the closed pouch, taken from the rear and an opposite side of the pouch;

FIG. 4, a front elevation view of open pouch and with the binoculars displayed in the lid, in phantom;

FIG. 5, a perspective view, with the pouch turned and open, taken from a top rear corner of the pouch and showing the interior of the hinged lid;

FIG. 6, a vertical section view taken on the line 6-6 of FIG. 2; and FIG. 7, a vertical section, taken on the line 7-7 of FIG. 4.

Referring now to the drawings:

In the illustrated preferred embodiment, the clam shell pouch of the invention, shown generally at 10, includes a bag, shown generally at 12 and a lid, shown generally at 14.

Bag 12 includes a fabric, padded central section 16 having a peripheral wall 18 extending from the sides and front of the central section 20, towards and into engagement with a peripheral wall 22 of the lid 14, when the lid is closed to place the peripheral wall of the lid against the peripheral wall 18 of the bag 12. The peripheral wall 22 of the lid 14 projects from sides and front of a fabric, padded central section 24 of the lid to engage the peripheral wall 18 of the bag. Each peripheral wall 18 and 22 has a rigid metal rod 26, shaped to form and hold the shape of the mouth of bag 12 and the rim of lid 14. Each rod 26 is inserted into a fabric sleeve 28, made of thick, compressible fabric and the thick compressible fabric is sewn to the edges of the peripheral wall 18 and the peripheral wall 22.

A fabric hinge strip 30, has opposite ends 32 and 34 respectively connected to the opposite ends of peripheral walls 18 and 22, at the rear of pouch 10. Side edges 36 and 38 of the hinge strip 30 are respectively connected to the rear of the bag 12 and to the rear of the lid 14. Triangular fabric pieces 40 and 42 have respective apexes 44 and 46 attached to the opposite ends 32 and 34 of the fabric hinge strip 30. Edges 48 and 50 of the fabric pieces 40 and 42 are attached to peripheral wall 18 of the pouch and edges 52 and 54 of the fabric pieces 40 and 42 are attached to the peripheral wall 22 of the lid 14. Gathered seams 56 and 58, are respectively sewn from the apexes 44 and 46 to the respective center of the base edges 60 and 62 of the triangular fabric pieces 40 and 42. The seams 56 and 58 are gathered on the mutually facing surfaces of the triangular fabric pieces 40 and 42, whereby closure of the bag and lid will fold the triangular pieces inwardly into pouch 10.

Small magnets 64 are each enrobed in a mesh net 66 having interconnected small diameter strands 68, made of a strong, durable, soft material.

Magnets 64, enrobed in mesh net 66, are spaced around and attached by sewing, or otherwise, to the interior of peripheral wall 18 of the bag. At least two strands 68 of net mesh 66 extend across a positive or negative face of the magnet. The positive or negative cooperating face of each magnet attached to the interior of peripheral wall 18 is the same for each magnet attached to the peripheral wall 18 and the face is positioned at a level closely below the cooperating fabric surface of the sleeve 28 on the wall 18. Similarly, magnets 64 enrobed in mesh net 66 are spaced around and attached by sewing, or otherwise to the interior of peripheral wall 22 of lid 14. The magnets 64 attached to peripheral wall 22 are positioned in the same manner as the magnets attached to the peripheral wall 18, but with the cooperating magnetic surface having an opposite polarity to that of the magnets attached to the peripheral wall 18.

Each magnet 64, spaced around the peripheral wall 18, has a cooperating surface that will be magnetically attracted to a cooperating surface of a similarly mounted magnet 64 attached to the peripheral wall 22.

When the bag 12 and lid 14 are manually pivoted towards one another, the magnets attached to the bag and the magnets attached to the lid cooperate to pull the bag and lid together and to close pouch 10. As the magnets pull the bag and lid together the sleeves 28 on the peripheral walls are compressed, to fully seal the pouch 10. Thereafter, the magnetic attraction of the magnets on the peripheral wall of the bag and on the peripheral wall of the lid compress the strands 68 of the mesh net to allow the cooperating faces of the magnet to come close together while still being held apart by the compressed strands 68. The magnets do not actually engage, so closing of the pouch is very quiet. Likewise, when the pouch is opened no metal latch parts scrape or disengage and the pouch opens very quietly.

As with other known binocular pouches, a strap 70 has opposite ends 72 and 74 respectively attached to a back 76 of bag 12 to serve as a means for attaching pouch 10 to the waist belt (not shown) or chest harness straps, (not shown) of a user. End 72 of strap 70 is secured to the bag 12 between the central Section 16 and peripheral wall 22 at the side of peripheral wall 22 opposite hinge strip 30. The other end of strap 70 is attached between central section 16 and the hinge strip 30 of bag 12. A flat, fabric reinforcement holder 74, having cut-away top and bottom notches 76 and 78, cut-away side notches 80 and 82 and a central opening 84 overlies the strap 70. Corners 86, 88, 90 and 92 of holder 74 are secured to the central section 16

A flexible fabric, pull tab 74 is fixed to and projects from the central section 24 of lid 14 at the edge of the central section 24 most remote from the hinge strip 30.

When used as carrier for binoculars, shown at 100 in FIGS. 1 and 4, pouch 10 is generally fixed to the waist belt, chest harness or another suitable holding means (not shown) that is attached to the body of a user, (not shown), using the holder 78 and/or strap 70 on the back 76 of bag 12. The binoculars, or other similar item(s), can be placed in the pouch, either before or after the pouch 10 is attached to a user. When binoculars of appropriate size are placed in the pouch the binoculars rest in the lid and extend into the bag when the lid is closed against the bag. Pulling tab 98 away from and downwardly with respect to the user, to the extent permitted by triangular fabric pieces 40 and 42, extends from the hinge away from the user and presents the binoculars for removal and use by the user. Mesh pockets 102, attached inside the bag and/or lid, hold items in place that are smaller than binoculars 100.

Although a preferred embodiment of our invention has been herein disclosed it is understood that such disclosure is by way of example and that variations are possible without departing from the subject matter coming within the scope of the following claims, which claims define our invention.

The invention claimed is:

1. A quiet opening and closing binocular clam shell pouch comprising:

a flexible bag having a peripheral wall forming an open mouth of said flexible bag;

a padded fabric sleeve fixed to said peripheral wall;

a rigid member in said padded fabric sleeve, whereby the shape of said open mouth of said flexible bag is determined by the shape of said rigid member;

a flexible lid having a flat fabric center conforming to the shape of the open mouth of said flexible bag;

a peripheral wall extending around and projecting from said flat fabric center;

a padded fabric sleeve fixed to said peripheral wall of said flexible lid;

a rigid member in said padded fabric sleeve of said lid, said rigid member in said padded fabric sleeve of said lid conforming in shape to said rigid member in said padded fabric sleeve of said bag;

a fabric hinge interconnecting said bag and said lid;

a plurality of first magnets spaced around and fixed to said peripheral wall of said bag, each said first magnet having a magnetic surface positioned alongside said padded sleeve of said bag and each said said magnetic surface of each said first magnet fixed to said peripheral wall being of the same magnetic polarity; and a plurality of second magnets spaced around and fixed to said peripheral wall of said lid, each said second magnet having a magnetic surface positioned alongside said padded sleeve of said lid and said magnetic surface of each said second magnet having the a magnetic polarity opposite to the magnetic polarity of each said first magnet, and said first and second magnets being aligned such that each first magnet attracts a second cooperating magnet to compress said padded sleeves of said bag and of said lid, to hold said lid in position covering said bag opening and wherein said compressed padded sleeves prevent contact between said first and second magnets.

2. A quiet opening and closing binocular clam shell pouch as in claim 1, further including:

a net mesh bag surrounding each first and second magnet, said net mesh bags surrounding said first magnets being attached to the peripheral wall of the bag, and said net mesh bag surrounding the second magnets being attached to the peripheral wall of the lid.

3. A quiet opening and closing binocular clam shell pouch as in claim 2, wherein:

the net mesh bag surrounding each first and second magnet is made of soft material, whereby string of said net mesh bags extending across the cooperating magnetic surfaces of the first and second magnets is compressed when said first and second cooperating magnets are attracted to close the lid on the bag.

4. A quiet opening and closing binocular clam shell pouch as in claim 3, further including:

means on a back surface of the bag for securing the pouch in an upright position with the fabric hinge then connecting the bag and the lid at a bottom of the pouch and a pull tab extending from the lid at the top of the upright wall of the lid.

* * * * *